US010347226B2

(12) United States Patent
Berg

(10) Patent No.: US 10,347,226 B2
(45) Date of Patent: Jul. 9, 2019

(54) REVERSIBLE GUITAR BRIDGE

(71) Applicant: Sean Michael Berg, Rice Lake, WI (US)

(72) Inventor: Sean Michael Berg, Rice Lake, WI (US)

( * ) Notice: Subject to any disclaimer, the term of this patent is extended or adjusted under 35 U.S.C. 154(b) by 171 days.

(21) Appl. No.: 15/691,707

(22) Filed: Aug. 30, 2017

(65) Prior Publication Data

US 2018/0061377 A1 Mar. 1, 2018

Related U.S. Application Data

(60) Provisional application No. 62/381,603, filed on Aug. 31, 2016.

(51) Int. Cl.
*G10D 3/04* (2006.01)
*G10D 1/08* (2006.01)

(52) U.S. Cl.
CPC ..... *G10D 3/04* (2013.01); *G10D 1/08* (2013.01); *G10D 1/085* (2013.01)

(58) Field of Classification Search
CPC ..... G10D 3/04; G10D 1/08; G10D 1/085
See application file for complete search history.

(56) References Cited

U.S. PATENT DOCUMENTS 5,398,581 A * 3/1995 Castillo ..... G10D 1/085 84/267
5,834,665 A * 11/1998 Hanns ..... G10D 3/04 84/298
5,994,633 A * 11/1999 Norton ..... G10D 1/085 84/290
2011/0146472 A1* 6/2011 Chetrit ..... G10D 1/08 84/298
2016/0098976 A1* 4/2016 Smith ..... G10D 3/04 84/298

* cited by examiner

*Primary Examiner* — Daniel J Colilla
(74) *Attorney, Agent, or Firm* — Michael R Shevlin

(57) ABSTRACT

A reversible guitar bridge that can be flipped over or reversed on the guitar body to allow the same guitar to play with the right hand or left hand. The guitar strings remain attached to the reversible guitar bridge and are moved to the opposite side of the bridge when it is reversed.

19 Claims, 4 Drawing Sheets

REVERSIBLE GUITAR BRIDGE

CROSS-REFERENCE TO RELATED APPLICATIONS

This application claims priority from U.S. Provisional Patent Application No. 62/381,603, filed on Aug. 31, 2016, the contents of which is incorporated herein by reference.

FIELD

The present invention relates to field of musical instruments, and more particularly, to stringed instruments having a reversible guitar bridge that allows quick reversal from right-handed to left-handed.

BACKGROUND

Most guitars are built to play either right-handed or left-handed with the guitar strings attached in a particular order between the bridge and neck. To switch a guitar from right-handed to left-handed play requires removal and reattachment of the guitar strings in reverse order. This reversal may be a long and cumbersome process to complete.

What is needed is an easily reversible guitar system and method for converting a right-handed guitar to a left-handed guitar in a reversible manner.

SUMMARY OF THE INVENTION

The present invention discloses a reversible guitar bridge that allows quick reversal from right-handed to left-handed without the need to repeatedly set the string intonation of the guitar. This is possible because the string saddles extend above and below the bridge plate such that when the bridge is flipped, the intonation pattern is a mirror image of the pattern that existed prior to the bridge being flipped. This allows the Reversible Guitar Bridge to be reversed by disconnecting the strings from the guitar neck, flipping the bridge, and re-attaching the strings to the neck in the opposite order (when the bridge is installed in a guitar that is intended to be reversible).

According to some embodiments, the invention provides a reversible guitar bridge comprising a bridge plate having first and second surfaces configured to be removably coupled to a guitar body with one or more bridge screws and multiple string saddles coupled to the bridge plate, each string saddle having a first end extending from a first surface of the bridge plate and a second end extending from the second surface of the bridge plate, the first and second ends being configured to engage a guitar string.

According to some embodiments, the invention provides a reversible guitar bridge comprising a bridge plate having multiple saddle openings configured to be removably coupled to a guitar body with bridge screws, the bridge plate having first and second surfaces, wherein in a first position the first surface faces away from the guitar body and in a second position the bridge plate is reversed and the second surface faces away from the guitar body and multiple string saddles, each saddle positioned in a saddle opening having a first end extending from the first surface and a second end extending from the second surface, the first and second ends being configured to engage a guitar string, wherein in the first bridge plate position the guitar string engages the first end of the string saddle and in a second bridge plate position the guitar string engages the second end of the string saddle.

According to some embodiments, the invention provides method of using a reversible guitar bridge to change a guitar from right handed to left handed play or left handed to right handed play, the method comprising removing one or more bridge screws holding the reversible guitar bridge in a first position to the guitar body, positioning the reversible guitar bridge in a second position to the guitar body, the second position being opposite the first position, and attaching the reversible guitar bridge to the guitar body with the bridge screws.

There has thus been outlined, rather broadly, the more important features of the invention in order that the detailed description thereof may be better understood, and in order that the present contribution to the art may be better appreciated. There are additional features of the invention that will be described hereinafter and which will form the subject matter of the claims appended hereto. The features listed herein and other features, aspects and advantages of the present invention will become better understood with reference to the following description and appended claims.

BRIEF DESCRIPTION OF THE DRAWINGS

The present embodiments may be understood from the following detailed description when read in conjunction with the accompanying figures. It is emphasized that the various features of the figures are not necessarily to scale. On the contrary, the dimensions of the various features may be arbitrarily expanded or reduced for clarity.

DETAILED DESCRIPTION

Embodiments of the invention will now be described with reference to the figures, wherein like numerals reflect like elements throughout. The terminology used in the description presented herein is not intended to be interpreted in any limited or restrictive way, simply because it is being utilized in conjunction with detailed description of certain specific embodiments of the invention. Furthermore, embodiments of the invention may include several novel features, no single one of which is solely responsible for its desirable attributes or which is essential to practicing the invention described herein.

Figure 1:
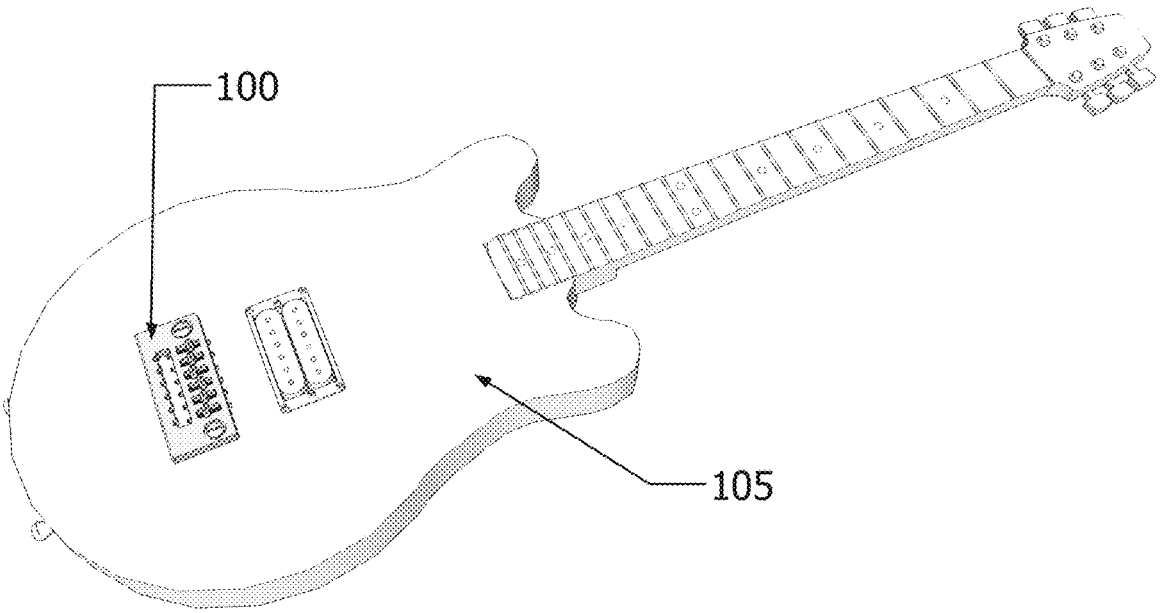
FIG. 1 shows one embodiment of a reversible guitar bridge.

FIG. 1 shows one embodiment of a reversible guitar bridge 100 attached to a guitar body 105 configured for quick reversal of guitar strings from right-handed to left-handed play without the need to repeatedly set the string intonation of the guitar.

Figure 2A:
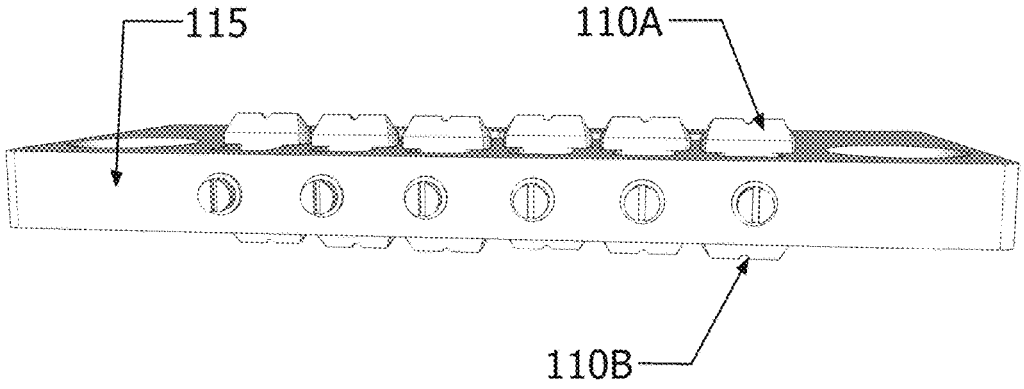
FIGS. 2A-2C are front, rear and side views of the reversible guitar bridge.
Figure 2B:
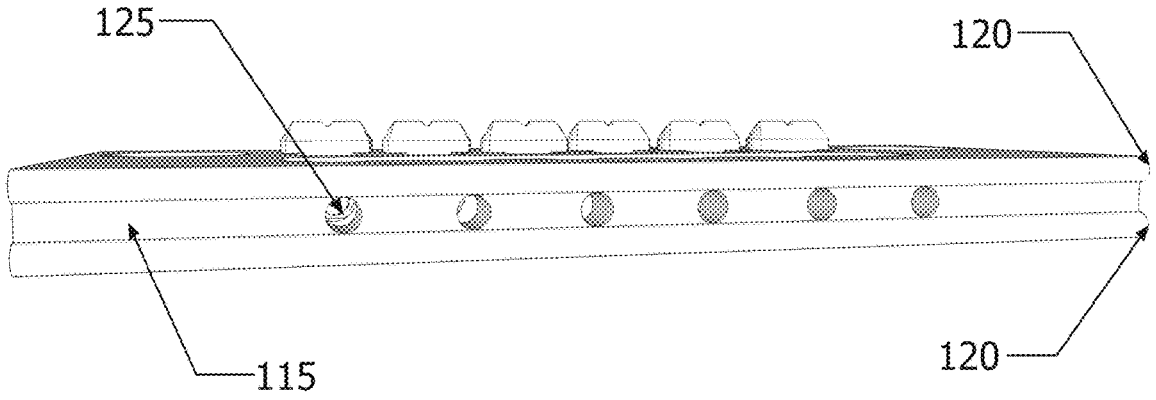
Figure 2C:
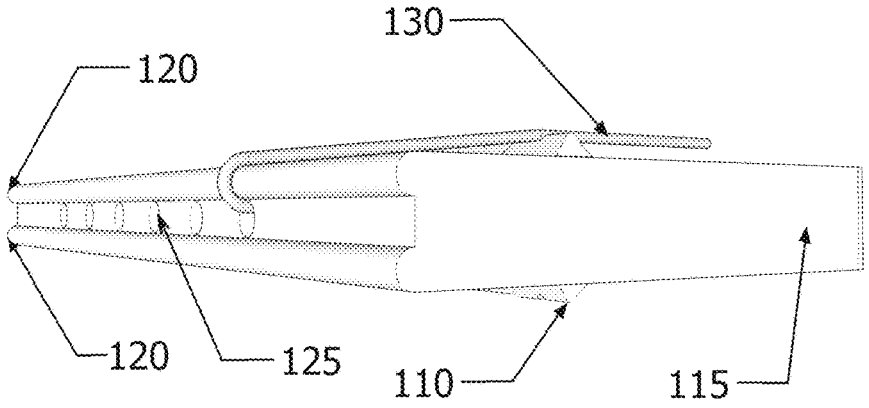

FIGS. 2A-2C are front, rear and side views of the reversible guitar bridge 100 showing string saddles 110 having a first end 110A extending above a bridge plate 115 and a second end 110B extending below the bridge plate 115. The rear of the bridge plate 115 has two radiuses 120 that span the length of the bridge along either side of string retainer holes 125, such that when the bridge is flipped and a guitar string 130 is moved from string saddle end 110A to string saddle end 110B, the intonation pattern is a mirror image of the pattern that existed prior to the bridge being flipped. This allows the reversible guitar bridge 100 to be reversed by disconnecting the strings 130 from the guitar neck, flipping the reversible guitar bridge over while flipping the strings to the other side, and re-attaching the strings to the guitar tuners on the neck in the opposite order.

Figure 3A:
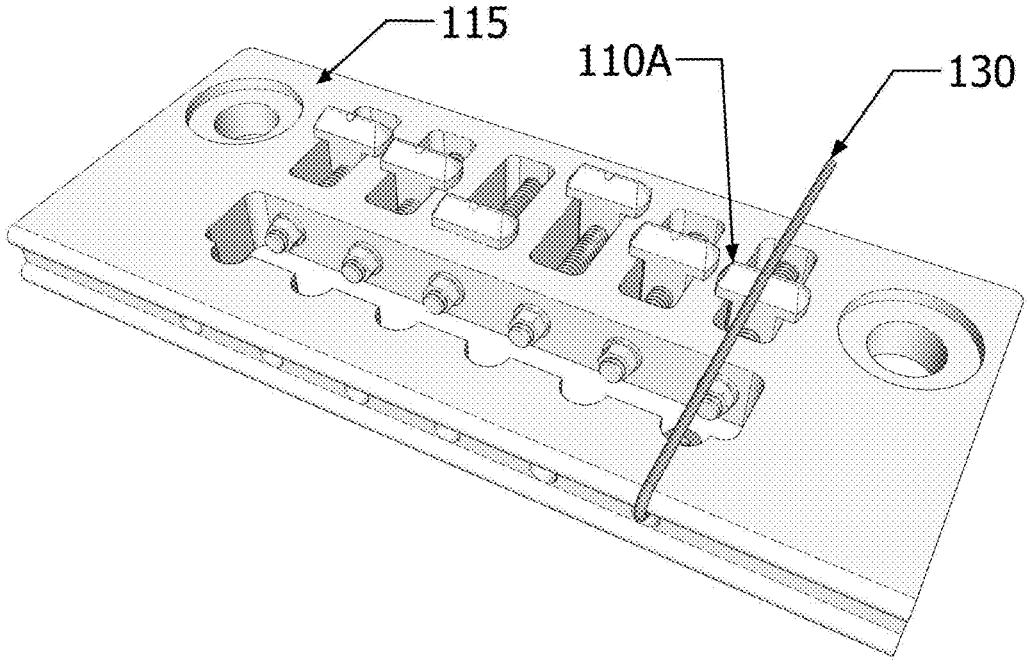
FIG. 3A-3B show the reversible guitar bridge and strings in a first position and second reversed position.
Figure 3B:
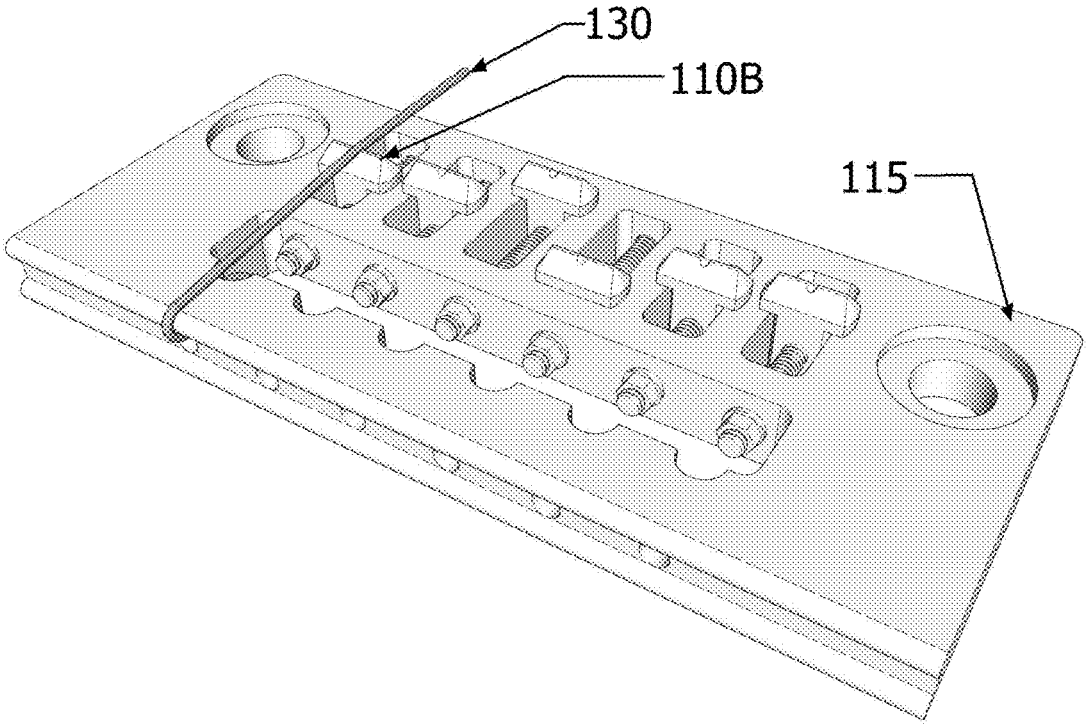

FIG. 3A shows the reversible guitar bridge 100 and strings 130 in a first position wrapped around the first radius contacting string saddle 110A, then the reversible guitar bridge 100 flipped over with strings 130 in a second position wrapped around the second radius contacting string saddle 110B, shown in FIG. 3B. By reversing or flipping the reversible guitar bridge 100, the reversible guitar bridge 100 may be set up for left or right handed play.

Components

Figure 4:
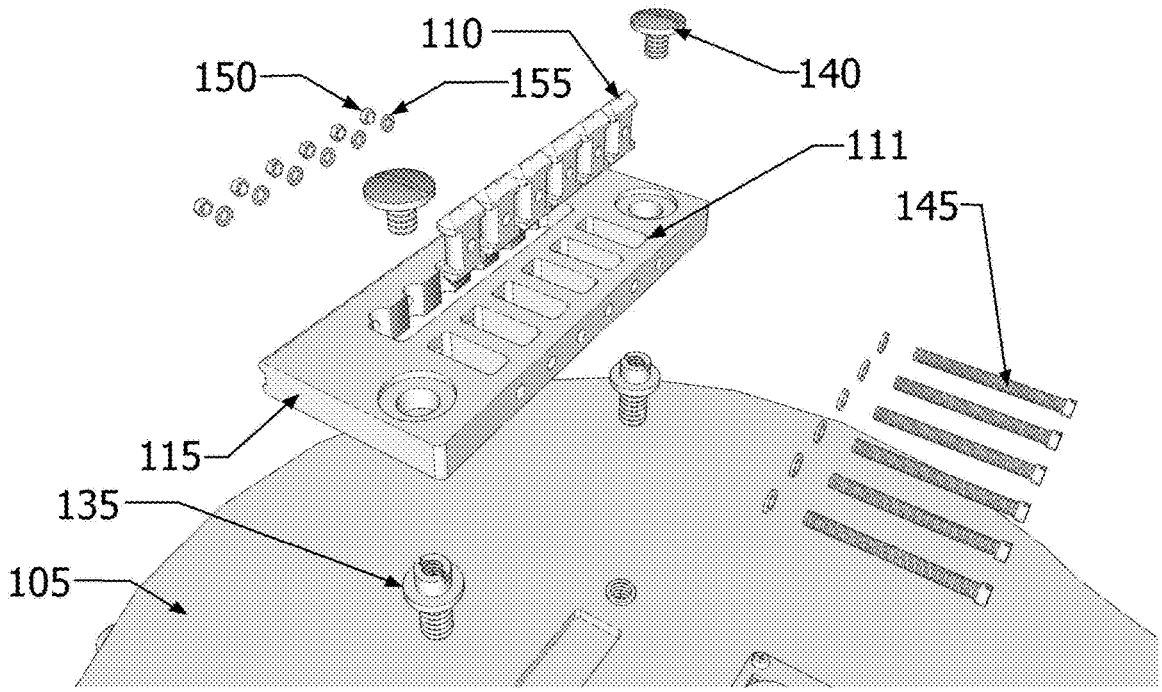
FIG. 4 shows an exploded view of the reversible guitar bridge.

FIG. 4 shows an exploded view of the reversible guitar bridge 100 consisting of multiple saddles 110, bridge plate 115, height adjustable bridge posts 135, bridge screws 140, saddle adjustment screws 145, saddle lock nuts 150, nylon washers 155.

To assemble the reversible guitar bridge 100, the saddles 110 are positioned in saddle openings 111 in the bridge plate 115 and the saddle adjustment screws 145 are then inserted through the saddles and the saddle lock nuts 150 and nylon washers 155 are attached to keep them in place. The bridge plate 115 may then be attached to the guitar body using the height adjustable bridge posts 135 and bridge screws 140.

The saddles 110 may have a threaded hole to engage the saddle adjustment screws 145 so that rotating the saddle adjustment screws 145 moves the saddle either forward or backward in the saddle opening 111.

Reversing the Bridge

Reversing the Reversible Guitar Bridge consists of the following steps:

1. Disconnect the strings 130 from the guitar tuners.
2. Remove the two Bridge Screws 140.
3. Remove the Reversible Guitar Bridge 110 from the Height Adjustable Bridge Posts 135 and flip it over.
4. Move each guitar string 130 to wrap around the opposite radius 120, then put the Bridge back onto the Bridge Posts.
5. Reinstall the Bridge Screws.
6. Reattach the guitar strings to the appropriate tuners.
7. Tune the guitar.

While embodiments and applications of this invention have been shown and described, it would be apparent to those skilled in the art that many more modifications than mentioned above are possible without departing from the inventive concepts herein. It is to be understood that the present disclosure is illustrative only and that changes, variations, substitutions, modifications and equivalents will be readily apparent to one skilled in the art and that such may be made without departing from the spirit of the invention as defined by the following claims.

The invention claimed is:

1. A reversible guitar bridge comprising:

a bridge plate having first and second surfaces configured to be removably coupled to a guitar body with one or more bridge screws; and multiple string saddles coupled to the bridge plate, each string saddle having a first end extending from a first surface of the bridge plate and a second end extending from the second surface of the bridge plate, the first and second ends being configured to engage a guitar string.

2. The reversible guitar bridge of claim 1, wherein each string saddle is positioned in a saddle opening of the bridge plate.

3. The reversible guitar bridge of claim 2, further comprising saddle adjustment screws configured to move the string saddle either forward or backward in the saddle opening.

4. The reversible guitar bridge of claim 1, wherein in a first position the first surface of the bridge plate faces away from the guitar body and in a second position the second surface of the bridge plate faces away from the guitar body.

5. The reversible guitar bridge of claim 4, wherein the guitar string engages the first end in the first position and the second end in the second position.

6. The reversible guitar bridge of claim 4, wherein in the guitar bridge includes a rear portion having first and second radiuses configured to hold an end of the guitar strings, wherein in the first position the guitar strings are wrapped around the first radius contacting the first end and in the second position guitar strings are wrapped around the second radius contacting the second end.

7. The reversible guitar bridge of claim 1, further comprising height adjustable bridge posts coupled to the bridge plate configured to adjust a distance between the bridge plate and guitar body.

8. The reversible guitar bridge of claim 1, wherein in the first position the bridge plate is set up for right handed play of the guitar and in the second position the bridge plate is set up left handed play of the guitar.

9. A reversible guitar bridge comprising:

a bridge plate having multiple saddle openings configured to be removably coupled to a guitar body with bridge screws, the bridge plate having first and second surfaces, wherein in a first position the first surface faces away from the guitar body and in a second position the bridge plate is reversed and the second surface faces away from the guitar body; and multiple string saddles, each saddle positioned in a saddle opening having a first end extending from the first surface and a second end extending from the second surface, the first and second ends being configured to engage a guitar string;

wherein in the first bridge plate position the guitar string engages the first end of the string saddle and in a second bridge plate position the guitar string engages the second end of the string saddle.

10. The reversible guitar bridge of claim 9, further comprising height adjustable bridge posts coupled to the bridge plate configured to adjust a distance between the bridge plate and guitar body.

11. The reversible guitar bridge of claim 9, further comprising saddle adjustment screws configured to move the string saddle either forward or backward in the saddle opening.

12. The reversible guitar bridge of claim 9, wherein in the guitar bridge includes a rear portion configured to hold an end of the guitar strings, the rear portion having first and second radiuses, wherein in the first position the guitar strings are wrapped around the first radius contacting the first end and in the second position guitar strings are wrapped around the second radius contacting the second end.

13. The reversible guitar bridge of claim 9, wherein in the first position the bridge plate is set up for right handed play of the guitar and in the second position the bridge plate is set up left handed play of the guitar.

14. A method of using a reversible guitar bridge to change a guitar from right handed to left handed play or left handed to right handed play, the method comprising:

removing one or more bridge screws holding the reversible guitar bridge in a first position to the guitar body, the reversible guitar bridge having:

a bridge plate having first and second surfaces; and multiple string saddles coupled to the bridge plate, each string saddle having a first end extending from the first surface and a second end extending from the second surface, the first and second ends being configured to engage a guitar string;

positioning the reversible guitar bridge in a second position to the guitar body, the second position being opposite the first position; and attaching the reversible guitar bridge to the guitar body with the bridge screws.

15. The method of claim 14, further comprising disconnecting a first end of guitar strings from guitar tuners on the guitar body prior to removing the reversible guitar bridge and reattaching the guitar strings to the appropriate tuners after attaching the reversible guitar bridge.

16. The method of claim 15, further comprising moving each guitar string from engagement with the first end to engagement with the second end of the string saddles.

17. The method of claim 16, further comprising tuning the guitar.

18. The method of claim 16, wherein the reversible guitar bridge includes height adjustable bridge posts and the method further comprising adjusting a height of the reversible guitar bridge on the guitar body using the height adjustable bridge posts.

19. The method of claim 16, wherein each saddle is positioned within a saddle opening in the bridge plate, the method further comprising adjusting the string saddles forward or backward in the saddle opening using a saddle adjustment screw.

* * * * *